US010886622B1

(12) United States Patent
Patel

(10) Patent No.: US 10,886,622 B1
(45) Date of Patent: Jan. 5, 2021

(54) TUNABLE ANTENNA ISOLATORS

(71) Applicant: HRL Laboratories, LLC, Malibu, CA (US)

(72) Inventor: Amit M. Patel, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 153 days.

(21) Appl. No.: 16/054,154

(22) Filed: Aug. 3, 2018

Related U.S. Application Data

(60) Provisional application No. 62/568,752, filed on Oct. 5, 2017.

(51) Int. Cl.
*H01Q 15/00* (2006.01)
*H01P 1/20* (2006.01)
*H01Q 1/52* (2006.01)

(52) U.S. Cl.
CPC ..... *H01Q 15/006* (2013.01); *H01P 1/2005* (2013.01); *H01Q 1/525* (2013.01)

(58) Field of Classification Search
CPC ..... H01P 1/2005; H01Q 15/006; H01Q 15/0066; H01Q 15/0073; H01Q 15/008; H01Q 15/0086; H01Q 1/52; H01Q 1/521; H01Q 1/523; H01Q 1/525; H01Q 1/526; H01Q 1/528
See application file for complete search history.

(56) References Cited

U.S. PATENT DOCUMENTS

2007/0182639 A1* 8/2007 Sievenpiper ..... H01Q 15/008 343/700 MS
2012/0190296 A1* 7/2012 Sarabandi ..... H01Q 1/525 455/7
2016/0344093 A1* 11/2016 Tagi ..... H01Q 1/243

FOREIGN PATENT DOCUMENTS

DE 102006012452 A1 * 10/2007 ..... H01P 1/2005

OTHER PUBLICATIONS

Agarwal et al., "Isolation improvement of 5 GHz WLAN antenna array using metamaterial absorber," 2016 URSI Asia-Pacific Radio Science Conference (URSI AP-RASC), Seoul, 2016, pp. 1050-1053.
Sievenpiper et al., "High-impedance electromagnetic surfaces with a forbidden frequency band," in IEEE Transactions on Microwave Theory and Techniques, vol. 47, No. 11, pp. 2059-2074, Nov. 1999.

* cited by examiner

*Primary Examiner* — Daniel Munoz
(74) *Attorney, Agent, or Firm* — Ladas & Parry

(57) ABSTRACT

A tunable antenna isolator includes a first wall, a second wall, and an electromagnetic band-gap (EBG) structure located between the first wall and the second wall. The first wall may be a metallic wall or an EBG structure, and the second wall may be a metallic wall or an EBG structure.

12 Claims, 8 Drawing Sheets

TUNABLE ANTENNA ISOLATORS

CROSS REFERENCE TO RELATED APPLICATIONS

This application is related to and claims priority from U.S. Provisional Patent Application Ser. No. 62/568,752, filed Oct. 5, 2017, which is incorporated herein by reference as though set forth in full.

STATEMENT REGARDING FEDERAL FUNDING

None.

TECHNICAL FIELD

This disclosure relates to antennas and reducing interference from a transmitting antenna to a receiving antenna.

BACKGROUND

Simultaneous transmit and receive (STAR) systems often require high levels of isolation, for example 140+ dB in electronic warfare (EW) applications. In the prior art, the bulk of the isolation is achieved through a combination of notch filters, backend digital filtering, and active cancellation circuitry. The coupling pathways between the transmit (Tx) and receive (Rx) apertures, as shown in FIG. 1A, are often unmitigated and require the apertures to be placed far apart from each other in order to meet the required overall system isolation requirements. The filtering electronics and cancellation circuitry are fairly compact; therefore, the overall compactness of STAR systems is often limited by distance between Tx and Rx antennas which must be spaced sufficiently far apart to generate the needed, isolation beyond that provided by the electronics. Shrinking these systems would ease their deployment on compact platforms such as UAVs and decoys.

A transmitter/jammer can interfere with receivers on the same platform through two main pathways: coupling through free-space propagation including multi-path effects, and surface coupling or "skin effects. While there are operational techniques that can be used to distinguish jamming signals from received signals, such as by using frequency management, where the receiver performs its search function in bands that are not being jammed, physically increasing the isolation between these signals enables more flexibility in system design and reduces the burden on the signal processing/filtering electronics.

In the prior art, physical isolation is achieved by placing metallic chokes, radar absorbing material, or electromagnetic band-gap (EBG) structures, or simply space, between the antennas. These account for about 15-20 dB of isolation, necessitating expensive cutting-edge electronics to handle the rest of the needed isolation.

Traditional EBG structures are narrowband and only affect the surface component of interference. Besides only affecting the surface component, MAGRAM is heavy and its effectiveness degrades at low frequencies (below 2 GHz). Prior art metallic chokes are essentially metal walls that are placed between the Tx and Rx antennas to prevent them from "seeing" each other. The metallic chokes are simple to fabricate but do not create deep isolation. Furthermore, radiating currents on the metallic choke walls produce parasitic interference and can affect coupling and modify the pattern of the original antennas.

Electromagnetic band-gap (EBG) structures are described by D. Sievenpiper, Lijun Zhang, R. F. J. Broas, N. G. Alexopolous and E. Yablonovitch, in "High-impedance electromagnetic surfaces with a forbidden frequency band," in IEEE Transactions on Microwave Theory and Techniques, vol. 47, no. 11, pp. 2059-2074, November 1999, which showed that a propagation stop-band can be created by using metal patches on a grounded substrate with vias.

Metamaterial structures for isolation are described by M. Agarwal and M. K. Meshram, "Isolation improvement of 5 GHz WLAN antenna array using metamaterial absorber," 2016 URSI Asia-Pacific Radio Science Conference (URSI AP-RASC), Seoul, 2016, pp. 1050-1053. Metamaterial structures are placed between antennas to improve isolation; however, they do not stop free-space coupling.

What is needed is an improved apparatus and method for providing isolation between a transmitter and a receiver. The embodiments of the present disclosure answer these and other needs.

SUMMARY

In a first embodiment disclosed herein, a tunable antenna isolator comprises a first metallic wall, a second metallic wall, and an electromagnetic band-gap (EBG) structure located between the first metallic wall and the second metallic wall.

In another embodiment disclosed herein, a method for providing a tunable antenna isolator comprises providing a first metallic wall, providing a second metallic wall, and providing an electromagnetic band-gap (EBG) structure located between the first metallic wall and the second metallic wall.

In yet another embodiment disclosed herein, a tunable antenna isolator comprises a first electromagnetic band-gap (EBG) structure, a second electromagnetic band-gap (EBG) structure, and a third electromagnetic band-gap (EBG) structure located between the first electromagnetic band-gap (EBG) structure and the second electromagnetic band-gap (EBG) structure.

In still yet another embodiment disclosed herein, a method for providing a tunable antenna isolator comprises providing a first electromagnetic band-gap (EBG) structure, providing a second electromagnetic band-gap (EBG) structure, and providing a third electromagnetic band-gap (EBG) structure located between the first electromagnetic band-gap (EBG) structure and the second electromagnetic band-gap (EBG) structure.

These and other features and advantages will become further apparent from the detailed description and accompanying figures that follow. In the figures and description, numerals indicate the various features, like numerals referring to like features throughout both the drawings and the description.

DETAILED DESCRIPTION

Figure 1:
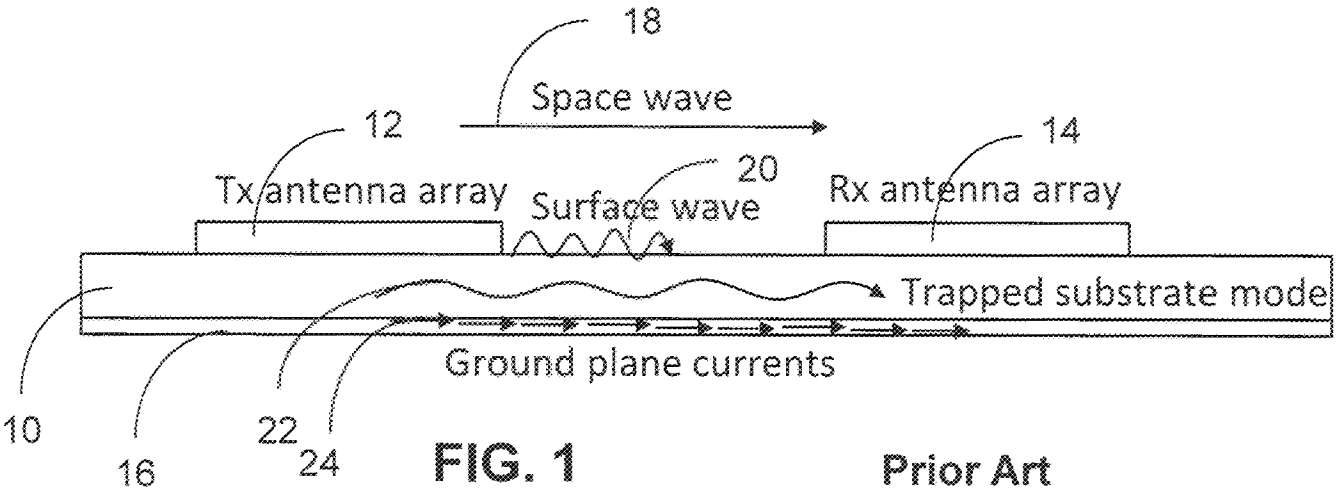
FIG. 1 Prior Art
FIG. 1 shows potential coupling pathways for two antennas sharing a substrate and a ground plane in accordance with the prior art.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

A choke-like structure made with electromagnetic band-gap (EBG) walls filled with tunable EBGs is described, which reduces both the surface and space components of interference over a broad bandwidth unlike traditional EBG surfaces, impedance surfaces, and MAGRAM. EBG chokes may be cascaded with overlapping bandgaps to improve instantaneous bandwidth. Tuning elements are described that provide for tunable bandwidths for deep isolation over a large bandwidth (e.g. 2-18 GHz). The tuning elements can include varactors, switches, capacitors in shunt, resistors, diodes and inductors in series. GaN for the varactors and switches can be used for high power handling making this technology viable for electronic warfare (EW) applications. Traditional EBG structures are narrowband and only affect the surface component of interference. Besides only affecting the surface component, MAGRAM is heavy and its effectiveness degrades at low frequencies (below 2 GHz). Traditional metallic chokes are simple to fabricate but do not create deep isolation. Furthermore, radiating currents on the metallic choke walls produce parasitic interference and can affect coupling and modify the pattern of the original antennas. The choke-like structures described here with tunable EBGs allow for deeper isolation than competing technologies over a large bandwidth, and at high power levels.

The chokes of the present disclosure improve the isolation between Tx and Rx systems at the aperture level, enabling overall system miniaturization by closer aperture spacing and/or reducing the isolation burden on the complex signal processing/filtering electronics. These new high-power handling tunable chokes, which can be integrated or retrofitted onto the surfaces of vehicles and other existing platforms, increase the isolation between sensitive receivers and interfering antennas located on the same platform by 30-40 dB more than the prior art, without negatively affecting the original antenna patterns. In one example, a 10 times reduction in spacing between Tx and Rx apertures was achieved with 0.5 meters spacing reduced to 0.05 meters, while maintaining the original isolation level.

The resulting improvement in isolation between receiver and transmitter/jammer provides multiple alternative benefits for the system designer, including the ability to increase jamming power, decrease burn-through, and/or reduce the complexity of front-end filtering electronics and isolation modules. Since the additional isolation is provided at the front of the receive chain, it provides additional protection to the vulnerable semiconductor electronics behind the antennas (LNA, etc.). The benefits are not restricted to EW systems; for example in radar systems where Tx and Rx antennas are closely located, the engineered choke can enable increased radar sensitivity.

FIG. 1 shows potential coupling pathways for a Tx antenna 12 and a receive antenna 14 sharing a substrate 10 and a ground plane 16. A space wave 18 may transmit directly from the Tx antenna to the Rx antenna. In addition a surface wave 20 may propagate along the surface of the substrate 10, a trapped substrate mode wave 22 may propagate internal to the substrate, and ground plane currents 24 may propagate in the ground plane 16 from the Tx antenna 12 to the Rx antenna 14.

In the prior art, physical isolation is achieved by placing metallic chokes, radar absorbing material, or electromagnetic band-gap (EBG) structures, or simply space, between the Tx and Rx antennas.

Figure 2:
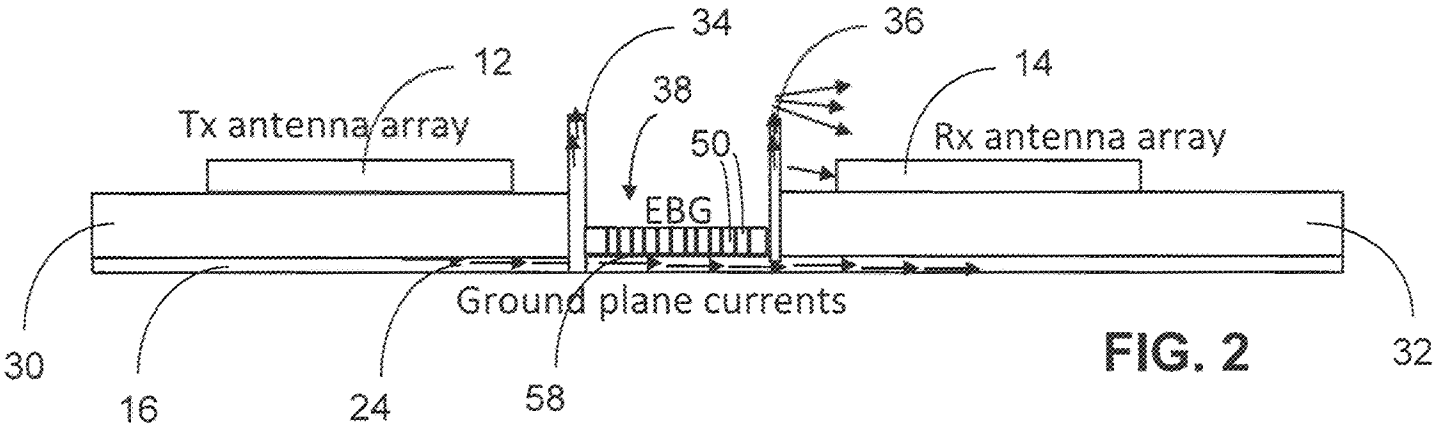
FIG. 2 shows a tunable electromagnetic band-gap (EBG) choke in accordance with the present disclosure.

FIG. 2 shows a tunable electromagnetic band-gap (EBG) choke in accordance with the present disclosure. The Tx and Rx antenna are still on the same ground plane 16; however, the substrate is split into a Tx antenna substrate 30 and a Rx antenna substrate 32. In the space between the Tx antenna substrate 30 and a Rx antenna substrate 32, a tunable electromagnetic band-gap (EBG) choke is located. The EBG choke has a metallic or metal wall 34, which is electrically connected to the ground plane 16, located on or near an end of the substrate 30 and between the Tx antenna 12 and the Rx antenna 14, and a metallic or metal wall 36, which is electrically connected to the ground plane 16, located on or near an end of the substrate 32 and between the Tx antenna 12 and the Rx antenna 14. The metal walls 34 and 36 may have the same or different dimensions in height, width and thickness. In between metal wall 34 and metal wall 36 is an EBG structure 38 with EBG unit cells 50, which are described further below. Each EBG unit cells 50 in EBG structure 38 has a ground plane 58 which is electrically coupled to ground planes 58 in the other EBG unit cells 50 and also electrically coupled to ground plane 16 and to metal walls 34 and 36. As shown in FIG. 2 the metal walls 34 and 36 may each be in a plane orthogonal to the ground plane 16 and orthogonal to the EBG structure 38.

Ground plane currents 24 may still propagate in the ground plane 16 from the Tx antenna 12 to the Rx antenna 14; however, surface waves and substrate waves are reduced.

Figure 3A:
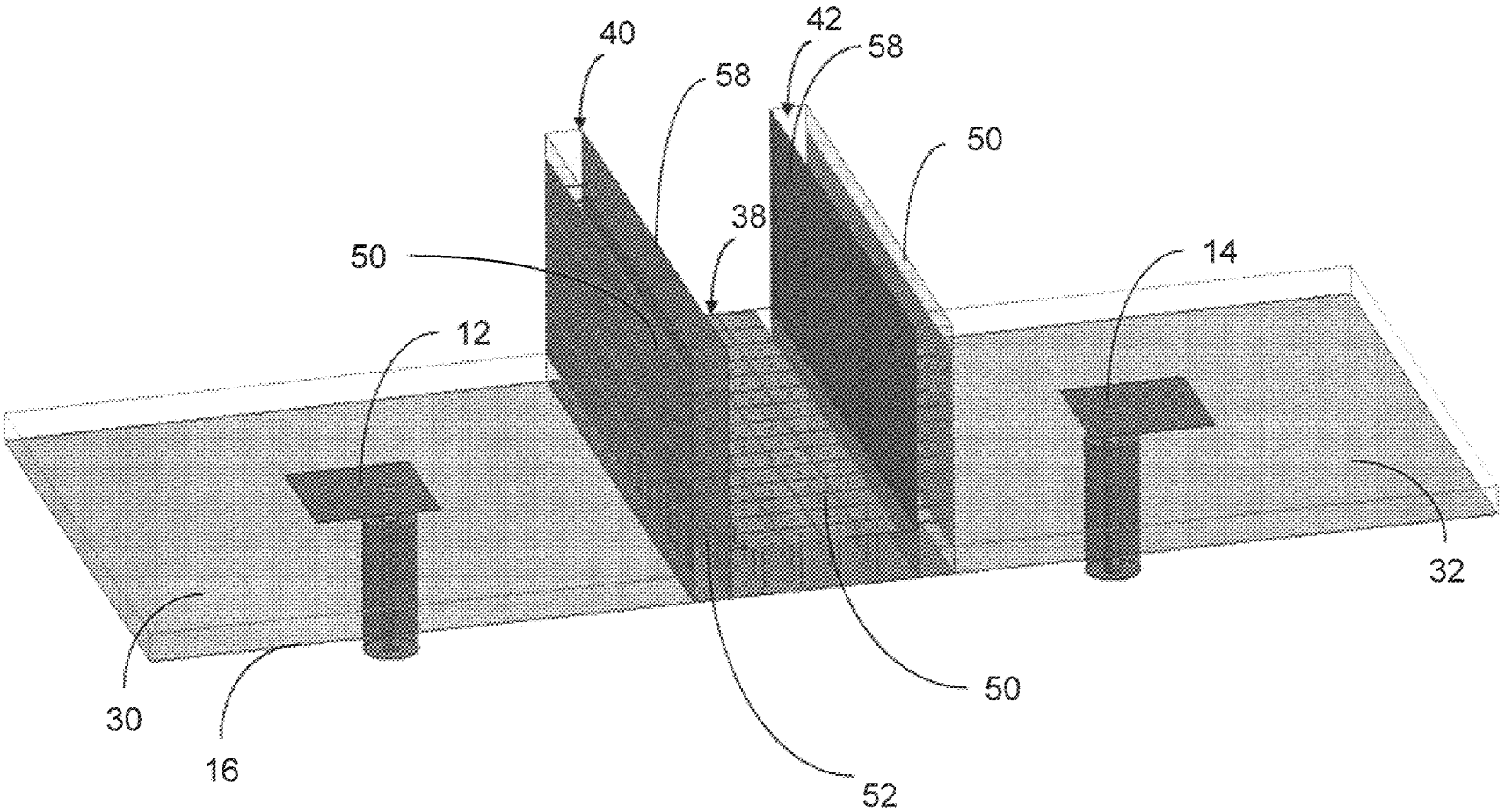
FIGS. 3A and 3B show another tunable electromagnetic band-gap (EBG) choke in accordance with the present disclosure.
Figure 3B:
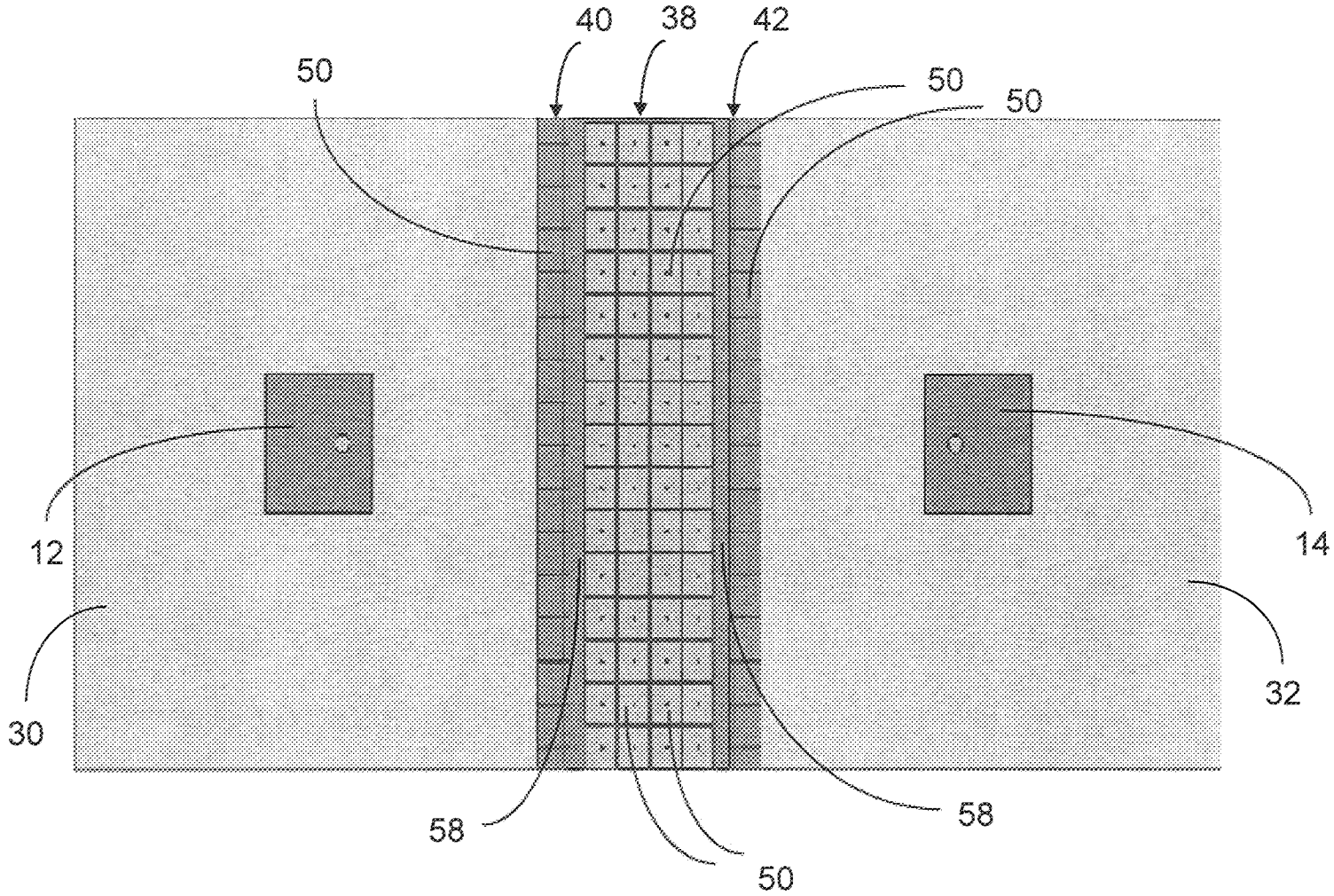

FIGS. 3A and 3B show a perspective and top view, respectively, of another tunable electromagnetic band-gap (EBG) choke in accordance with the present disclosure. In the EBG choke of FIGS. 3A and 3B, the EBG structure 38 is still present; however, the metal walls 34 and 36 are not present and instead are replaced by EBG structures 40 and 42 on each side of the EBG structure 38, which is in between EBG structure 40 and EBG structure 42. The EBG structures 38, 40 and 42 each have EBG unit cells 50. Each EBG unit cell 50 in EBG structure 40 has a ground plane 58 which is electrically coupled to ground planes 58 in the other EBG unit cells 50 in EBG structure 40 and also electrically coupled to ground plane 16. In the same manner, each EBG unit cell 50 in EBG structure 42 has a ground plane 58 which is electrically coupled to ground planes 58 in the other EBG unit cells 50 in EBG structure 42 and also electrically coupled to ground plane 16. Each EBG unit cell 50 in EBG structure 38 has a ground plane 58 which is electrically coupled to ground planes 58 in the other EBG unit cells 50 in EBG structure 38 and also electrically coupled to ground plane 16 and to the ground planes 58 in EBG structure 40 and EBG structure 42. The ground plane 58 of EBG structure 38 may also be physically connected to ground plane 16.

The EBG unit cells 50 in EBG structure 40 are on a side of the EBG structure 40 that faces the Tx antenna 12 on Tx antenna substrate 30, so that the ground plane 58 of EBG structure 40 faces the EBG structure 42. EBG unit cells 50 in EBG structure 42 are on a side of the EBG structure 42 that faces the Rx antenna 12 on Rx antenna substrate 32, so that the ground plane 58 of EBG structure 42 faces the EBG structure 40. As shown in FIG. 2 the EBG structure 40 and the EBG structure 42 may each be in a plane orthogonal to the ground plane 16 and orthogonal to the EBG structure 38.

Ground plane currents 24 may still propagate in the ground plane 16 from the Tx antenna 12 to the Rx antenna 14; however, surface waves and substrate waves are substantially reduced. The EBG choke can also be used between two transmit antennas to reduce surface and substrate waves.

Figure 4:
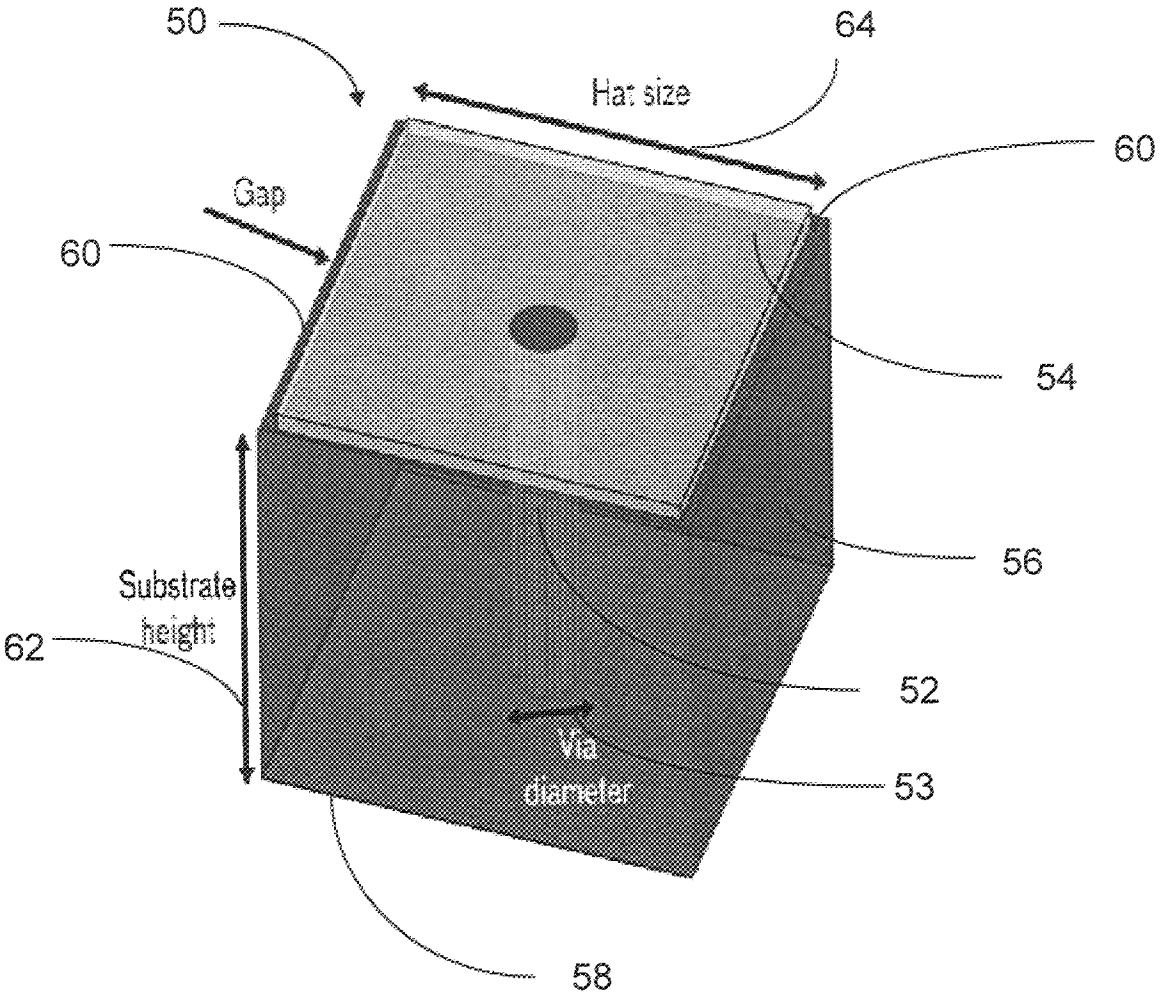
FIG. 4 shows a perspective view of an EBG unit cell of the tunable electromagnetic band-gap (EBG) choke in accordance with the present disclosure.

FIG. 4 shows a perspective view of an EBG unit cell 50. The EBG unit cell 50 includes a dielectric 56 with a metallic HAT 54 on one side of the dielectric 56 and a metallic ground plane 58 on a side of the dielectric 56 opposite the metallic HAT 54. The dielectric 56 may be in the shape of a cube. The length and width dimensions of the metallic HAT 54 on one side of the dielectric 56 are less than the corresponding length and width dimensions of the dielectric 56 on that side, so that a gap 60 surrounds the metallic HAT 54. The metallic HAT 54 is electrically connected to the ground plane 58 by a metallic via 52. The length and width dimensions of the ground plane 58 on one side of the dielectric 56 are the same as the corresponding length and width dimensions of the dielectric 56 on that side, so that the ground planes 58 of adjacent EBG unit cells are physically and electrically connected.

The height 62 of the EBG unit cell 50 may be 1.4 mm, the HAT size 64 of the metallic HAT 54 may be 2.25 mm on each side so that the HAT is square, the gap 60 surrounding the metallic HAT 54 may be 0.15 mm, and the via diameter 53 may be 0.38 mm. The dielectric constant of dielectric 56 may be 2.2.

In general, both the HAT size 64 and the height 62 must be subwavelength of a frequency of operation. For example, the the HAT size 64 may be a wavelength of operation divided by three or lambda/3, and the height 62 may be a wavelength of operation divided by one hundred or lambda/100.

Figure 5C:
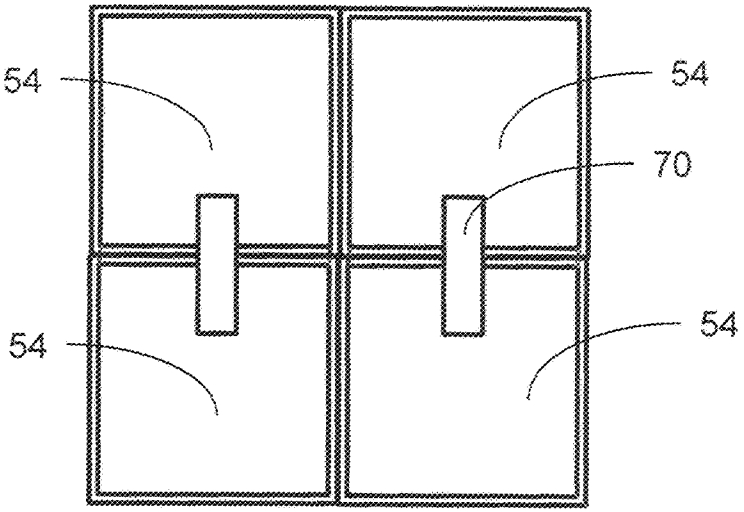
FIG. 5C shows a top view of EBG unit cells with tuning elements between the unit cells.
Figure 5A:
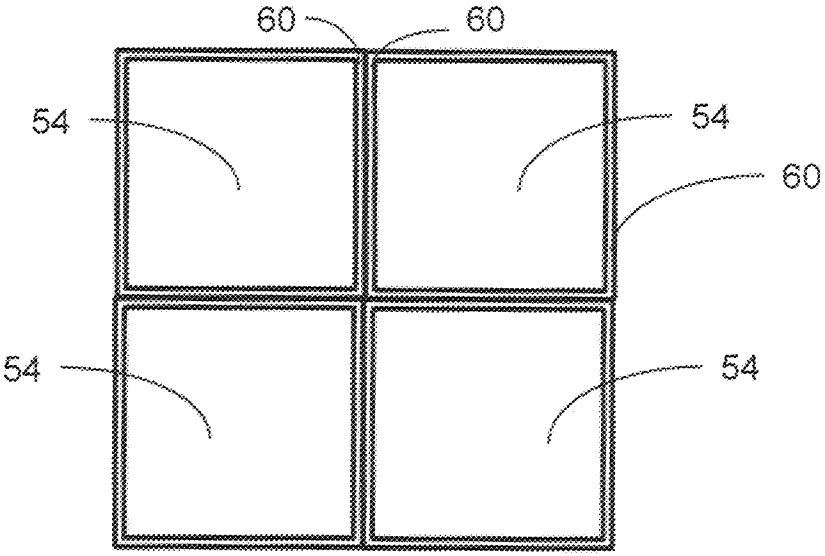
FIG. 5A shows a top view of EBG unit cells.
Figure 5B:
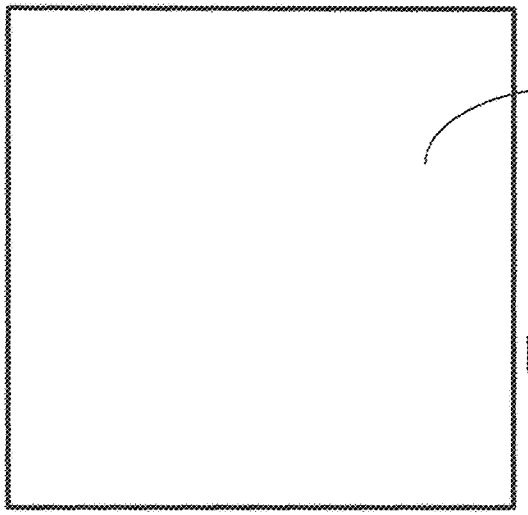
FIG. 5B shows a bottom view of multiple EBG unit cells showing the common ground plane.

FIG. 5A shows a top view of multiple adjacent EBG unit cells 50. Because each EBG unit cell has a gap 60 surrounding the metallic HAT 54, the effective gap between two adjacent metallic HATs 54 is two gaps 60, as shown in FIG. 5A. FIG. 5B shows a bottom view of multiple adjacent EBG unit cells 50 showing that each EBG unit cell ground plane 58 is connected to the ground planes 58 in other EBG unit cells 50. In effect the EBG unit cells have a common electrical ground plane 58, and may have a common physical ground plane 58.

Figure 5D:
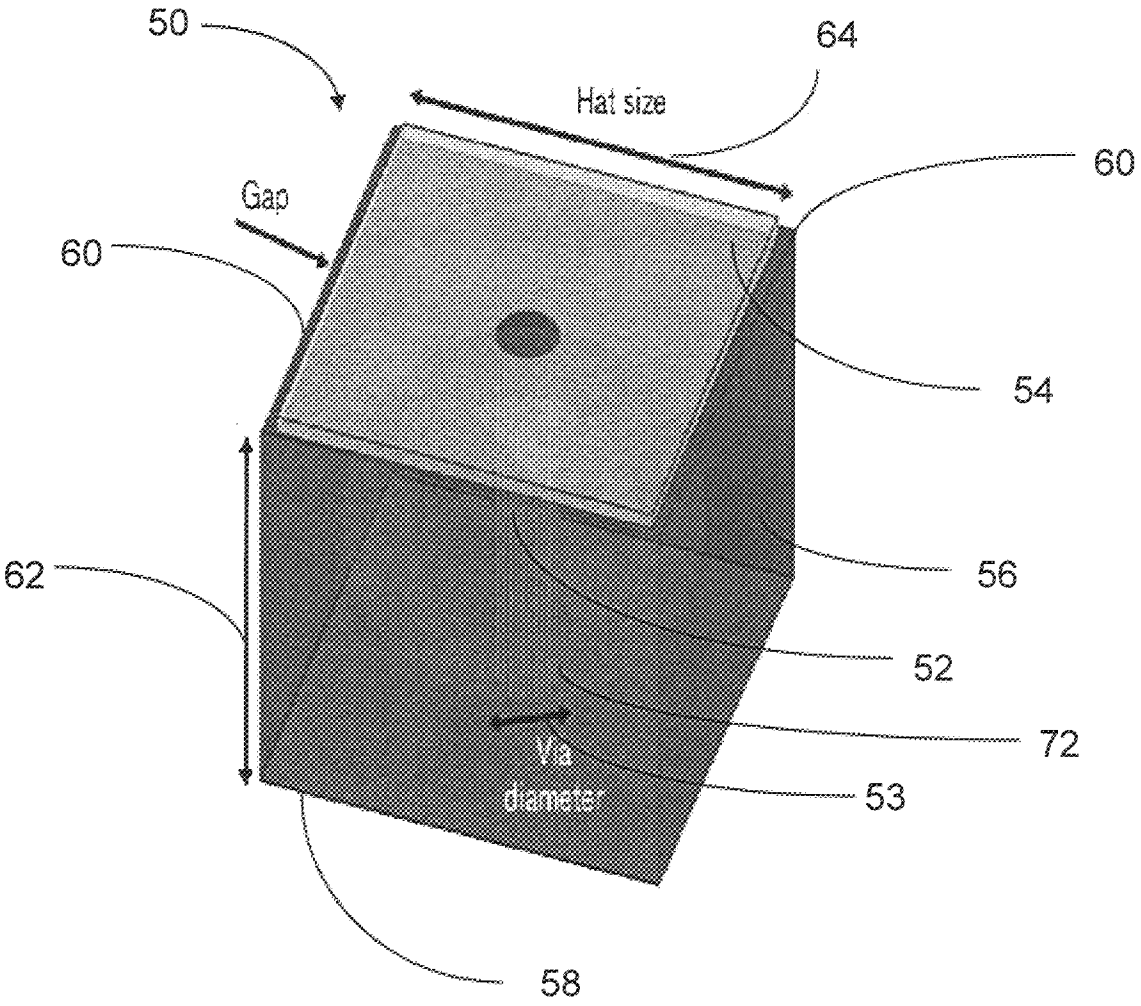
FIG. 5D shows a perspective view of a EBG unit cell with an embedded inductor, and in accordance with the present disclosure.

FIG. 5C shows a top view of EBG unit cells 50 with tuning elements 70 connected between metallic HATs 54 of adjacent EBG unit cells 50. The tuning elements 70 may include varactors, switches, capacitors, diodes, resistor and inductors. If the tuning elements 70 between adjacent metallic HATs 54 are switches, the switches may be switched on to electrically connect adjacent EBG metallic HATs 54, or switched off to electrically disconnect adjacent EBG metallic HATs 54. For high power applications the switches may be GaN. FIG. 5D shows a perspective view of an EBG unit cell 50 that has a tuning element 72 embedded in the dielectric 56. The embedded tuning element 72 may include an inductor, such as a spiral inductor, a capacitor, a diode, a resistor, a varactor or a switch.

Figure 6:
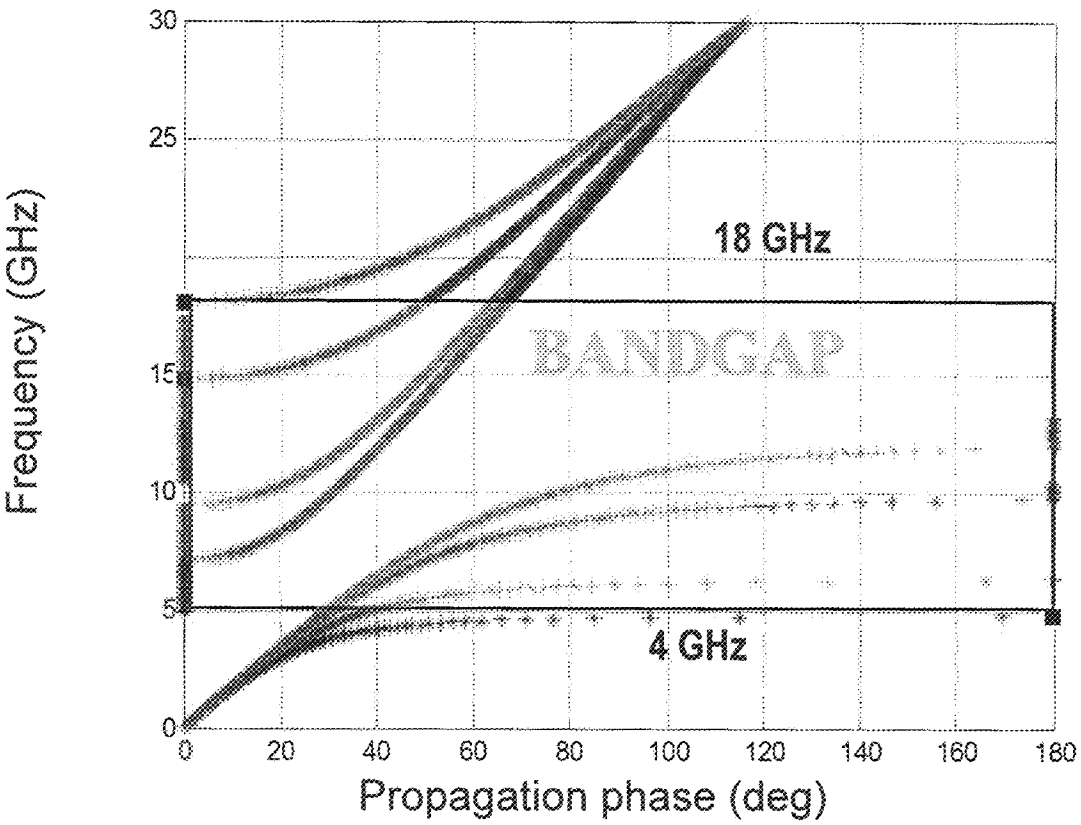
FIG. 6 shows that the large tunable band-gap provides isolation over a wide bandwidth in accordance with the present disclosure.

FIG. 6 shows a graph demonstrating that the tunable band-gap of the EBG structures can provide isolation over a wide bandwidth of operating frequencies, which may be, for example, 4-18 GHz.

Figure 7:
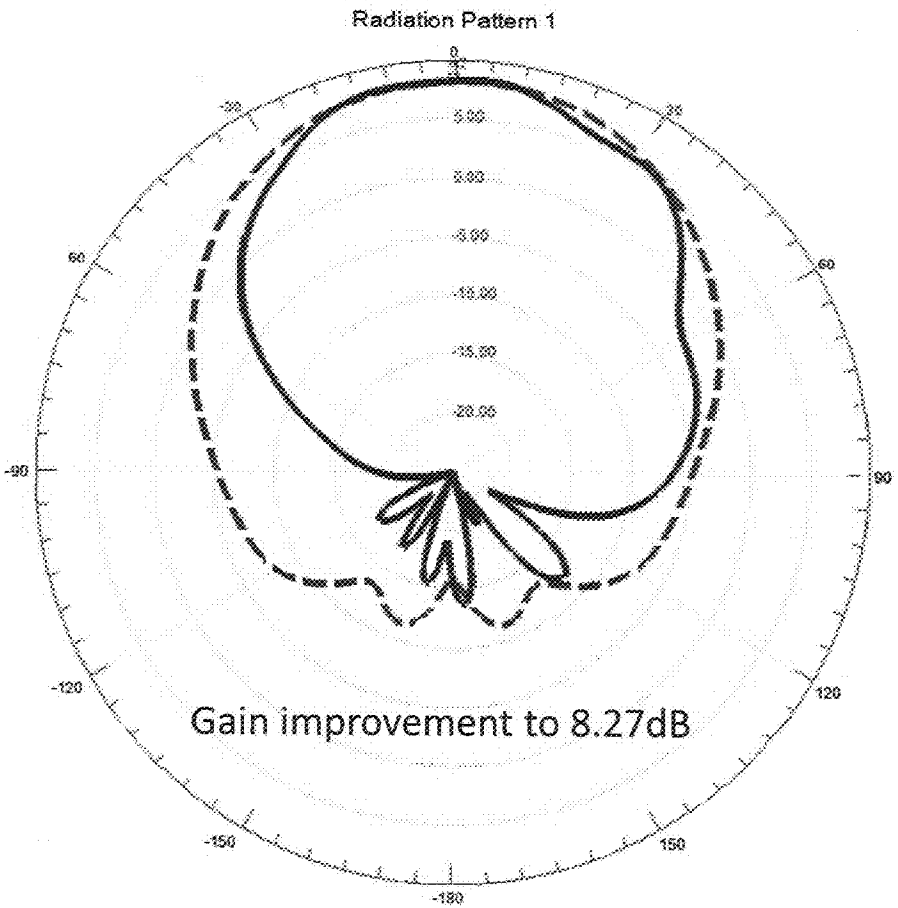
FIG. 7 shows a radiation pattern in accordance with the present disclosure.

FIG. 7 shows a radiation pattern showing a gain improvement for the antenna with the isolator. The antenna with the isolator achieved a a gain of 8.27 dB, which is an improvement over the antenna without the isolator, which only had a gain of 6.6 dB.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A tunable antenna isolator comprising:

a first metallic wall;

a second metallic wall;

an electromagnetic band-gap (EBG) structure located between the first metallic wall and the second metallic wall; and a first ground plane coupled to the first metallic wall, the second metallic wall and the electromagnetic band-gap (EBG) structure;

wherein a top surface of the electromagnetic band-gap (EBG) structure is below a first height of the first metallic wall and below a second height of the second metallic wall.

2. The tunable antenna isolator of claim 1 wherein the electromagnetic band-gap (EBG) structure is directly on the first ground plane.

3. The tunable antenna isolator of claim 1 wherein the electromagnetic band-gap (EBG) structure comprises:

a plurality of electromagnetic band-gap unit cells each comprising:

a dielectric having a first side having a first length dimension and a first width dimension;

a metallic HAT on the first side of the dielectric;

a second ground plane on a second side of the dielectric opposite the first side; and a metallic via extending through the dielectric electrically coupling the metallic HAT to the second ground plane;

wherein the second ground plane of each of the plurality of electromagnetic band-gap unit cells is coupled to and directly on the first ground plane.

4. The tunable antenna isolator of claim 3 wherein:

the metallic HAT has a second length dimension and a second width dimension that are less than the first length dimension and the first width dimension of the first side of the dielectric.

5. The tunable antenna isolator of claim 3 further comprising:

a tuning element coupled between adjacent metallic HATs; or a tuning element embedded in the dielectric.

6. The tunable antenna isolator of claim 5 wherein the tuning element comprises a varactor, a capacitor, a switch, a diode, an inductor or a resistor.

7. A method for providing a tunable antenna isolator comprising:

providing a first metallic wall;

providing a second metallic wall;

providing an electromagnetic band-gap (EBG) structure located between the first metallic wall and the second metallic wall; and providing a first ground plane coupled to the first metallic wall, the second metallic wall and the electromagnetic band-gap (EBG) structure;

wherein a top surface of the electromagnetic band-gap (EBG) structure is below a first height of the first metallic wall and below a second height of the second metallic wall.

8. The method of claim 7 wherein the electromagnetic band-gap (EBG) structure is directly on the first ground plane.

9. The method of claim 7 wherein providing the electromagnetic band-gap (EBG) structure comprises:

providing a plurality of electromagnetic band-gap unit cells each comprising:

a dielectric having a first side having a first length dimension and a first width dimension;

a metallic HAT on the first side of the dielectric;

a second ground plane on a second side of the dielectric opposite the first side; and a metallic via extending through the dielectric electrically coupling the metallic HAT to the second ground plane;

wherein the second ground plane of each of the plurality of electromagnetic band-gap unit cells is coupled to and directly on the first ground plane.

10. The method of claim 9 wherein:

a second length dimension and a second width dimension of the metallic HAT is less than the first length dimension and the first width dimension of the first side of the dielectric.

11. The method of claim 9 further comprising:

a tuning element coupled between adjacent metallic HATs; or a tuning element embedded in the dielectric.

12. The method of claim 11 wherein the tuning element comprises a varactor, a capacitor, a switch, a diode, an inductor or a resistor.

* * * * *